US007278904B2

(12) United States Patent
Woo et al.

(10) Patent No.: US 7,278,904 B2
(45) Date of Patent: Oct. 9, 2007

(54) METHOD OF ABRADING A WORKPIECE

(75) Inventors: Edward J. Woo, Woodbury, MN (US); Donna W. Bange, Eagan, MN (US); Craig F. Lamphere, Woodbury, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 35 days.

(21) Appl. No.: 10/982,503

(22) Filed: Nov. 5, 2004

(65) Prior Publication Data

US 2005/0113005 A1 May 26, 2005

Related U.S. Application Data

(63) Continuation-in-part of application No. 10/723,765, filed on Nov. 26, 2003, now abandoned.

(51) Int. Cl.
*B24B 1/00* (2006.01)

(52) U.S. Cl. ..... 451/28; 451/54; 451/59

(58) Field of Classification Search ..... 451/28, 451/526, 41, 539, 921, 532, 4, 36, 42, 43, 451/44, 54, 56, 59; 51/307, 295, 298; 510/424, 510/307; 428/402; 438/692; 439/692
See application file for complete search history.

(56) References Cited

U.S. PATENT DOCUMENTS 4,842,903 A * 6/1989 Hayner ..... 428/467
5,014,468 A 5/1991 Ravipati et al.
5,107,626 A 4/1992 Mucci
5,152,917 A 10/1992 Pieper et al.
5,262,073 A * 11/1993 Schmitt et al. ..... 508/287
5,286,782 A 2/1994 Lamb et al.
5,304,223 A 4/1994 Pieper et al.
5,346,556 A 9/1994 Perry et al.
5,354,797 A 10/1994 Anderson et al.
5,368,619 A 11/1994 Culler
5,378,251 A 1/1995 Culler et al.
5,435,816 A 7/1995 Spurgeon et al.
5,437,754 A 8/1995 Calhoun
5,453,312 A 9/1995 Haas et al.
5,454,844 A 10/1995 Hibbard et al.
5,470,368 A 11/1995 Culler
5,489,235 A 2/1996 Gagliardi et al.

(Continued)

FOREIGN PATENT DOCUMENTS

WO WO97/14534 4/1997

(Continued)

OTHER PUBLICATIONS

"McCutcheon's 2003 Volume I: Emulsifiers & Detergents" North American Edition: The Manufacturing Confectioner Publishing Co., Glen Rock, New Jersey, 2003 , pp. 302-306.

(Continued)

*Primary Examiner*—Jacob K. Ackun, Jr.
(74) *Attorney, Agent, or Firm*—Bradford B. Wright

(57) ABSTRACT

A method of abrading a surface of a workpiece with a structured abrasive article in the presence of a liquid comprising water and at least one of a sulfonate or sulfate anionic surfactant.

22 Claims, 1 Drawing Sheet

U.S. PATENT DOCUMENTS 5,496,387 A 3/1996 Culler
5,500,273 A 3/1996 Holmes et al.
5,518,512 A * 5/1996 Hibbard ..... 51/308
5,549,961 A 8/1996 Haas et al.
5,549,962 A 8/1996 Holmes et al.
5,580,647 A * 12/1996 Larson et al. ..... 442/417
5,628,952 A 5/1997 Holmes et al.
5,632,668 A 5/1997 Lindholm et al.
5,658,184 A 8/1997 Hoopman et al.
5,667,541 A 9/1997 Klun et al.
5,667,542 A 9/1997 Law et al.
5,672,097 A 9/1997 Hoopman
5,681,217 A 10/1997 Hoopman et al.
5,690,705 A 11/1997 Holmes et al.
5,700,302 A 12/1997 Stoetzel et al.
RE35,709 E 1/1998 Culler
5,714,259 A * 2/1998 Holmes et al. ..... 428/402
5,733,178 A 3/1998 Ohishi
5,783,303 A 7/1998 Tsuei
5,820,450 A 10/1998 Calhoun
5,833,724 A 11/1998 Wei et al.
5,837,763 A * 11/1998 Ferraro et al. ..... 524/449
5,840,090 A 11/1998 Ho et al.
5,851,247 A * 12/1998 Stoetzel et al. ..... 51/295
5,855,632 A 1/1999 Stoetzel et al.
5,863,305 A 1/1999 Beardsley et al.
5,863,306 A 1/1999 Wei et al.
5,888,119 A 3/1999 Christianson et al.
5,908,476 A 6/1999 Nishio et al.
5,908,477 A 6/1999 Harmer et al.
5,913,716 A 6/1999 Mucci et al.
5,928,394 A 7/1999 Stoetzel
5,942,015 A * 8/1999 Culler et al. ..... 51/295
5,946,991 A 9/1999 Hoopman
5,954,844 A 9/1999 Law et al.
5,958,794 A * 9/1999 Bruxvoort et al. ..... 438/692
5,975,987 A 11/1999 Hoopman et al.
5,975,988 A 11/1999 Christianson et al.
5,989,111 A 11/1999 Lamphere et al.
6,017,831 A 1/2000 Beardsley et al.
6,017,872 A 1/2000 Pedersen et al.
6,039,775 A 3/2000 Ho et al.
6,048,375 A 4/2000 Yang et al.
6,048,677 A 4/2000 Chen et al.
6,056,794 A 5/2000 Stoetzel et al.
6,076,248 A 6/2000 Hoopman et al.
6,080,215 A 6/2000 Stubbs et al.
6,110,015 A 8/2000 Christianson et al.
6,129,540 A 10/2000 Hoopman et al.
6,139,594 A 10/2000 Kincaid et al.
6,155,910 A 12/2000 Lamphere et al.
6,194,317 B1 2/2001 Kaisaki et al.
6,217,432 B1 4/2001 Woo
6,231,629 B1 5/2001 Christianson et al.
6,238,449 B1 * 5/2001 Woo et al. ..... 51/298
6,238,592 B1 5/2001 Hardy et al.
6,238,611 B1 5/2001 Hoopman
6,277,160 B1 8/2001 Stubbs et al.
6,293,980 B2 9/2001 Wei et al.
6,371,842 B1 4/2002 Romero
6,386,079 B2 5/2002 Hoopman
6,428,898 B1 8/2002 Barsotti et al.
6,458,018 B1 * 10/2002 Goers et al. ..... 451/41
6,475,253 B2 11/2002 Culler et al.
6,503,136 B1 1/2003 Rose et al.
6,521,574 B1 * 2/2003 Hirabayashi et al. ..... 510/175
6,544,593 B1 4/2003 Nagata et al.
6,551,933 B1 * 4/2003 Molnar ..... 438/690
6,638,144 B2 10/2003 Sventek et al.
6,645,624 B2 * 11/2003 Adefris et al. ..... 428/402
6,676,733 B2 * 1/2004 Ludwig et al. ..... 106/2
6,679,928 B2 1/2004 Costas et al.
6,910,951 B2 * 6/2005 Balijepalli et al. ..... 451/41
2001/0041511 A1 11/2001 Lack et al.
2002/0090901 A1 7/2002 Schutz et al.
2003/0022604 A1 1/2003 Annen et al.
2003/0032368 A1 2/2003 Hara
2003/0049995 A1 3/2003 Schutz et al.
2003/0143938 A1 7/2003 Braunschweig et al.
2003/0150169 A1 8/2003 Annen
2003/0166387 A1 9/2003 Chen et al.
2003/0181144 A1 9/2003 Mujumdar et al.
2003/0207659 A1 11/2003 Annen et al.
2004/0123527 A1 7/2004 Kitayama et al.

FOREIGN PATENT DOCUMENTS

WO WO 02/38338 A2 5/2002

OTHER PUBLICATIONS

Schwartz et al., "Surface-Active Agents and Detergents Volume II", R.E. Krieger Publishing Company, Huntigton, New York, 1977, pp. 40-102.
Product Brochure "Frequently Asked Questions on the 3M™ Trizact™ Finesse-it Paint Defect Repair System", 3M Industrial Business Customer Response Center (dated prior to Oct. 23, 2003), 2 pages.
Product Brochure "3M Paint Defect Repair System Instructions", 3M Industrial Business Customer Response Center, 2002, 4 pages.
Product Brochure "3M Trizact™ Abrasives A Consistent, predictable finish. Every time" (dated prior to Oct. 23, 2003) 2 pages.
Product Brochure "3M Trizact™ Finesse-it™ Paint Defect Repair System A Swirl-free finish in two steps", 3M Superabrasives and Microfinishing Systems Division, Oct. 13, 1999, 4 pages.
Product Brochure "3M Trizact™ Finesse-it™ Film Discs", Product Information Sheet, 3M Superabrasives and Microfinishing Systems Division, Effective Date: Oct. 13, 1999, 1 page.
"Method of Abrading a Workpiece", U.S.S.N. 10/723,765, Filed Nov. 26, 2003.
Brady et al., "Materials Handbook", 14th Edition, McGraw-Hill, New York, 1997, pp. 281-282.
Non-Final Office Action, dated Sep. 20, 2004, of record in U.S. Appl. No. 10/723,765, filed Nov. 26, 2003, Woo, E. J.

* cited by examiner

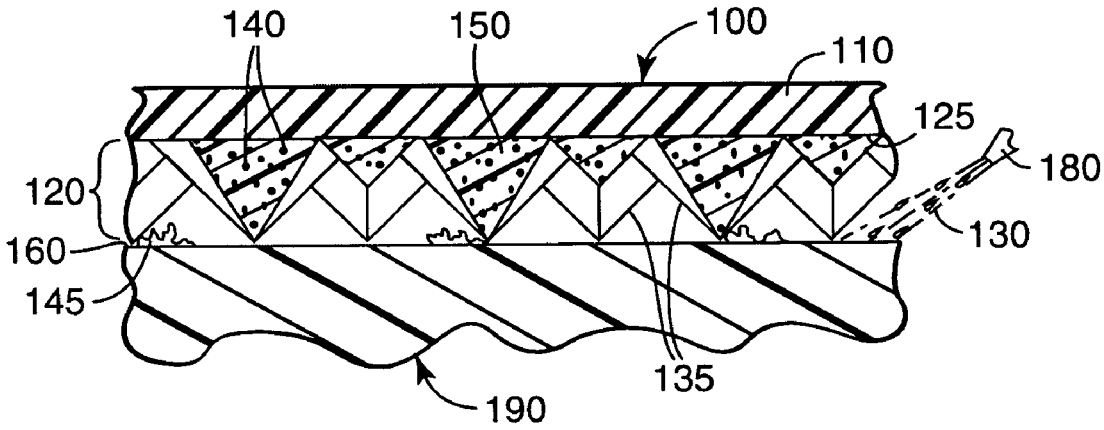
140
150
100
110
125
180
120
130
160
145
135
190

METHOD OF ABRADING A WORKPIECE

CROSS-REFERENCE TO RELATED APPLICATION

This application is a continuation-in-part of application Ser. No. 10/723,765, filed Nov. 26, 2003 abandoned.

BACKGROUND

Surface finishing and repair of glossy surfaces such as automotive paints and clearcoats, lacquer finishes, glossy plastics, and the like is commonly practiced by a two-step method. First, the surface area to be finished or repaired is abraded with an abrasive article, then in a second step the abraded surface is polished by buffing it in the presence of a polishing compound.

Structured abrasive articles, that is, those abrasive articles that have a plurality of shaped abrasive composites bonded to a backing, are widely used in the first abrading step. During abrading processes using structured abrasive articles, a liquid such as water or a cutting fluid is often added to the abrading interface to extend the useful life of the structured abrasive article.

SUMMARY

In one aspect, the present invention provides a method of abrading a surface of a workpiece comprising:

providing a structured abrasive article comprising a backing having opposed major surfaces and an abrasive layer comprising a plurality of shaped abrasive composites bonded to one of the major surfaces, wherein the abrasive composites comprise abrasive grains dispersed in a polymeric binder, and wherein the abrasive composites are preparable by at least partially polymerizing a slurry comprising a polymerizable binder precursor, abrasive grains, and a silane coupling agent;

contacting the abrasive layer with the surface of the workpiece;

contacting a liquid comprising water and at least one of a sulfonate or sulfate anionic surfactant with at least one of the workpiece or the abrasive article; and moving at least one of the abrasive layer and the surface of the workpiece relative to the other to abrade at least a portion of the surface of the workpiece.

In one embodiment, at least a portion of the shaped abrasive composites are precisely shaped.

In another embodiment, at least a portion of the shaped abrasive composites are not precisely shaped.

Methods according to the present invention typically extend the useful life of structured abrasive articles in abrading processes, which in turn may reduce the overall cost of the abrading processes and the amount of time required to replace worn structured abrasive articles.

BRIEF DESCRIPTION OF THE DRAWING

The drawing is a cross-sectional side view illustrating one exemplary method according to the present invention.

DETAILED DESCRIPTION

According to the present invention, a workpiece is abraded using a structured abrasive article in the presence of a liquid. An exemplary such process is illustrated in the drawing wherein a structured abrasive article 100, which has abrasive layer 120 bonded to one major surface 125 of backing 110, is brought into contact with workpiece 190. Abrasive layer 120 comprises a plurality of precisely shaped abrasive composites 135, each precisely shaped abrasive composite 135 comprising abrasive grains 140 in a polymeric binder 150. Abrasive layer 120 is moved relative to workpiece 190 while maintaining interface 160 thereby generating swarf 145. Liquid 130, which comprises water and at least one of a sulfonate or sulfate anionic surfactant, is introduced from dispenser 180 to interface 160, thereby reducing accumulation of swarf 145, for example, between adjacent precisely shaped abrasive composites 135.

Typically, during abrading processes, material abraded from the substrate or workpiece, also known as swarf, tends to fill the spaces between the shaped abrasive composites and/or cap the abrasive composite tips in a process known as "loading", which generally reduces the duration of useful life (i.e., cut life) of the structured abrasive. While not wishing to be bound by theory, it is believed that methods according to the present invention reduce the rate of accumulation of swarf (i.e., loose dust and debris generated during abrasion of the workpiece) on the surface of the abrasive layer, thereby extending the useful life of the structured abrasive article.

The present invention is achieved by abrading a workpiece with a structured abrasive article in the presence of a liquid that comprises water and at least one of a sulfonate or sulfate anionic surfactant.

Sulfate and sulfonate anionic surfactants are well-known in the art and are widely commercially available as described, for example, in "McCutcheon's 2003 Volume I: Emulsifiers & Detergents" (2003), North American Edition: The Manufacturing Confectioner Publishing Co., Glen Rock, N.J., pages 302–306 and/or may be prepared according to conventional methods such as, for example, those described by Schwartz, Perry, and Berch in "Surface-Active Agents and Detergents Volume II" (1977), R. E. Krieger Publishing Company, Huntington, N.Y., pages 40–102.

Useful sulfate anionic surfactants include water-soluble salts or acids of the formula $RO(A)_mSO_3M$ wherein:

R is a linear or branched alkyl or hydroxyalkyl group having from 8 to 30 carbon atoms (e.g., an alkyl or hydroxyalkyl group having from 12 to 18 carbon atoms);

A is $—CH_2CH_2O—$ or $—CH_2CH(CH_3)O—$;

M is H or a cation such as, for example, an metal cation (e.g., sodium, potassium, lithium, calcium, magnesium), or ammonium or substituted ammonium (e.g., methyl-, dimethyl-, and trimethylammonium cations, quaternary ammonium cations such as tetramethylammonium and dimethylpiperidinium cations, and quaternary ammonium cations derived from alkylamines such as ethylamine, diethylamine, triethylamine, and combinations thereof); and m is a positive integer greater than or equal to zero (e.g., in a range from at least 0, 1, or even 2 up to and including 3, 4, 5 or even 6).

Exemplary surfactants of this type include alkyl sulfates and alkyl polyether sulfates.

Useful sulfonate anionic surfactants include alkylsulfonates and alkyl aryl (i.e., alkaryl) sulfonates such as, for example, water-soluble salts or acids of the formula $R_1SO_3M$ wherein M is as defined hereinabove and $R_1$ is a linear or branched alkyl or alkenyl group having from 8 to 30 carbon atoms (e.g., an alkyl or alkenyl group having from 12 to 18 carbon atoms), an alkyl or dialkyl-subsituted aryl group having at least 8 carbon atoms in one alkyl moiety and at least 6 carbon atoms in the aryl moiety.

Useful sulfonate anionic surfactants also include, for example, mono- and di-alkyl sulfosuccinates having alkyl groups with from at least 8 carbon atoms up to 30 carbon atoms (e.g., 1,4-bis(2-ethylhexyl) sulfosuccinate), glycerol ether sulfonates, α-methyl ester sulfonates, sulfo fatty acids, fatty alcohol ether sulfates, glycerol ether sulfates, hydroxy-mixed ether sulfates, monoglyceride (ether) sulfates, fatty acid amide (ether) sulfates, mono- and dialkyl sulfosuccinates, mono- and dialkyl sulfosuccinamates, sulfotriglycerides, alkyl oligoglucoside sulfates, and combinations of any of the foregoing.

The at least one of a sulfate or sulfonate anionic surfactant is typically included in the liquid in an amount that is effective for extending the useful life of structured abrasive articles in the present abrading processes. For example, the at least one of a sulfate or sulfonate anionic surfactant may be included in the liquid in an amount of from at least 0.1, 0.25 percent, or 0.5 percent by weight up to and including 3 percent or even 5 percent by weight, based on the total weight of the liquid, although higher and lower amounts of the at least one of a sulfate or sulfonate anionic surfactant may also be effective.

The liquid may further comprise at least one of organic solvent, thickener, filler, colorant, grinding aid (e.g., mineral oil), or a combination thereof. Typically, organic solvent should be soluble in or miscible with water. Examples of organic solvent include ketones, ethers (including polyethers), ether esters, amides, nitriles, and combinations thereof. Typically, the liquid can be prepared by combining its component parts with mixing.

In one embodiment, the liquid may consist essentially of (i.e., be free of materials that materially affect the abrading performance of the structured abrasive article) water, optional organic solvent, and at least one of a sulfonate or sulfate anionic surfactant.

The liquid may be applied directly or indirectly to the surface of the workpiece to be abraded and/or to the abrasive layer of the structured abrasive article. For example, the liquid may be applied to surfaces that are opposed or peripheral to surface of the workpiece to be abraded or the abrasive layer of the structured abrasive article whereby the liquid flows or is otherwise brought to the interface formed between the abrasive layer and the surface of the workpiece.

The liquid may be discontinuously applied to the surface of the workpiece to be abraded and/or to the abrasive layer of the structured abrasive article. Examples of discontinuous application methods include pulsed sprays and streams (e.g., using a manual spray bottle), dip coating, and drip coating. Examples of continuous application methods include continuous sprays, streams, and immersion. The rate of application may be regulated or otherwise controlled, for example, manually, by computer, and/or mechanically.

The liquid may be applied to a portion or all (e.g., by flood coat or immersion) of the surface to be abraded and/or the abrasive layer.

In some embodiments, the liquid may contact the workpiece prior to contacting the abrasive layer with the surface of the workpiece.

In other embodiments, the liquid may contact the abrasive layer prior to contacting the abrasive layer with the surface of the workpiece.

The structured abrasive article may be moved relative to the workpiece by hand or by mechanical means such as, for example, an electric or air-driven motor using any method known in the abrasive art. The structured abrasive article may be removably fastened to a back up pad (e.g., as is common practice with discs) or may be used without a back up pad (e.g., in the case of abrasive belts).

Once abrading using the structured abrasive article is complete, the workpiece is typically rinsed (e.g., with water) to remove residue generated during the abrading process. After rinsing, the workpiece may be further polished using a polishing compound, for example, in conjunction with a buffing pad. Such optional polishing compound typically contains fine abrasive particles (e.g., having an average particle size of less than 100 micrometers, less than 50 micrometers, or even less than 25 micrometers) in a liquid vehicle. Further details concerning polishing compounds and processes are described in, for example, U.S. Pat. Appl. Pub. No. 2003/0032368 (Hara).

Structured abrasive articles, useful in practice of the present invention, generally have an abrasive layer comprising a plurality of non-randomly shaped abrasive composites that are affixed to a backing. As used herein, the term "abrasive composite" refers to a body that includes abrasive particles and a binder. In one embodiment, the shaped abrasive composites may be disposed on the backing according to a predetermined pattern (e.g., as an array).

In one embodiment, at least a portion of the shaped abrasive composites may comprise "precisely shaped" abrasive composites. This means that the shape of the abrasive composites is defined by relatively smooth surfaced sides that are bounded and joined by well-defined edges having distinct edge lengths with distinct endpoints defined by the intersections of the various sides. The terms "bounded" and "boundary" refer to the exposed surfaces and edges of each composite that delimit and define the actual three-dimensional shape of each abrasive composite. These boundaries are readily visible and discernible when a cross-section of an abrasive article is viewed under a scanning electron microscope. These boundaries separate and distinguish one precisely shaped abrasive composite from another even if the composites abut each other along a common border at their bases. By comparison, in an abrasive composite that does not have a precise shape, the boundaries and edges are not well defined (e.g., where the abrasive composite sags before completion of its curing).

Typically, the shaped abrasive composites are arranged on the backing according to a predetermined pattern or array, although this is not a requirement.

The shaped abrasive composites may be arranged such that some of their work surfaces are recessed from the polishing surface of the abrasive layer.

Suitable backings include backings used in the abrasive art such as, for example, polymeric film (including primed polymeric film), cloth, paper, foraminous and non-foraminous polymeric foam, vulcanized fiber, fiber reinforced thermoplastic backing, nonwovens, treated versions thereof (e.g., with a waterproofing treatment), and combinations thereof.

The backing can have one half of an attachment system on its back surface to secure the abrasive article to a support pad or back-up pad. This attachment system half can be, for example, a pressure-sensitive adhesive or tape, a loop fabric for a hook and loop attachment, a hook structure for a hook and loop attachment, or an intermeshing attachment system. Further details concerning such attachment systems may be found, for example, in U.S. Pat. No. 5,152,917 (Pieper et al.); U.S. Pat. No. 5,454,844 (Hibbard et al.); U.S. Pat. No. 5,672,097 (Hoopman); U.S. Pat. No. 5,681,217 (Hoopman et al.); and U.S. Pat. Appl. Pub. Nos. 2003/0143938 (Braunschweig et al.) and 2003/0022604 (Annen et al.).

The individual abrasive composites comprise abrasive grains dispersed in a polymeric binder.

Any abrasive grain known in the abrasive art may be included in the abrasive composites. Examples of useful abrasive grains include aluminum oxide, fused aluminum oxide, heat-treated aluminum oxide, ceramic aluminum oxide, silicon carbide, green silicon carbide, alumina-zirconia, ceria, iron oxide, garnet, diamond, cubic boron nitride, and combinations thereof. For repair and finishing applications, useful abrasive grain sizes typically range from an average particle size of from at least 0.01, 1, 3 or even 5 micrometers up to and including 35, 100, 250, 500, or even as much as 1,500 micrometers, although particle sizes outside of this range may also be used.

Examples of polymeric binders that are useful in abrasive composites include thermoplastic resins such as for example, polyesters, polyamides, and combinations thereof; thermoset resins such as, for example, phenolic resins, aminoplast resins, urethane resins, epoxy resins, acrylate resins, acrylated isocyanurate resins, cyanate resins, urea-formaldehyde resins, isocyanurate resins, acrylated urethane resins, acrylated epoxy resins, glue, and combinations thereof; and combinations thereof.

Structured abrasive articles are typically prepared by forming a slurry of abrasive grains and a solidifiable or polymerizable precursor of the abovementioned binder resin (i.e., a binder precursor), contacting the slurry with a backing and solidifying and/or polymerizing the binder precursor (e.g., by exposure to an energy source) in a manner such that the resulting structured abrasive article has a plurality of shaped abrasive composites affixed to the backing. Examples of energy sources include thermal energy and radiant energy (including electron beam, ultraviolet light, and visible light).

For example, in one embodiment, the slurry may be coated directly onto a production tool having precisely shaped cavities therein and brought into contact with the backing, or coated on the backing and brought to contact with the production tool. In this embodiment, the slurry is typically then solidified or cured while it is present in the cavities of the production tool.

To promote an association bridge between the abovementioned binder resin and the abrasive particles, a silane coupling agent is included in the slurry of abrasive grains and solidifiable or polymerizable precursor, typically in an amount of from about 0.01 to 5 percent by weight, more typically in an amount of from about 0.01 to 3 percent by weight, more typically in an amount of from about 0.01 to 1 percent by weight, although other amounts may also be used, for example depending on the size of the abrasive grains. Suitable silane coupling agents include, for example, methacryloxypropyl silane, vinyltriethoxysilane, vinyltri-(2-methoxyethoxy)silane, 3,4-epoxycyclohexylmethyl-trimethoxysilane, gamma-glycidoxypropyltrimethoxysilane, and gamma-mercaptopropyltrimethoxysilane (e.g., as available under the respective trade designations "A-174", "A-151", "A-172", "A-186", "A-187", and "A-189" from Dow Chemical Company, Midland, Mich.); allyltriethoxysilane, diallyldichlorosilane," divinyldiethoxysilane, and m,p-styrylethyltrimethoxysilane (e.g., as commercially available under the respective trade designations "A0564", "D4050", "D6205", and "S1588" from United Chemical Industries, Bristol, Pa.); dimethyldiethoxysilane, dihydroxydiphenylsilane; triethoxysilane; trimethoxysilane; triethoxysilanol; 3-(2-aminoethylamino)propyltrimethoxysilane; methyltrimethoxysilane; vinyltriacetoxysilane; methyltriethoxysilane; tetraethyl orthosilicate; tetramethyl orthosilicate; ethyltriethoxysilane; amyltriethoxysilane; ethyltrichlorosilane; amyltrichlorosilane; phenyltrichlorosilane; phenyltriethoxysilane; methyltrichlorosilane; methyldichlorosilane; dimethyldichlorosilane; dimethyldiethoxysilane; and similar compounds; and mixtures thereof.

Precisely shaped abrasive composites may be of any three-dimensional shape that results in at least one of a raised feature or recess on the exposed surface of the abrasive layer. Useful shapes include, for example, cubic, prismatic, pyramidal (e.g., square pyramidal or hexagonal pyramidal), truncated pyramidal, conical, frusto-conical. Combinations of differently shaped and/or sized abrasive composites may also be used. The abrasive layer of the structured abrasive may be continuous or discontinuous.

For fine finishing applications, the density of shaped abrasive composites in the abrasive layer is typically in a range of from at least 1,000, 10,000, or even at least 20,000 abrasive composites per square inch (e.g., at least 150, 1,500, or even 7,800 abrasive composites per square centimeter) up to and including 50,000, 70,000, or even as many as 100,000 abrasive composites per square inch (up to and including 7,800, 11,000, or even as many as 15,000 abrasive composites per square centimeter), although greater or lesser densities of abrasive composites may also be used.

Further details concerning structured abrasive articles having precisely shaped abrasive composites, and methods for their manufacture may be found, for example, in U.S. Pat. No. 5,152,917 (Pieper et al.); U.S. Pat. No. 5,435,816 (Spurgeon et al.); U.S. Pat. No. 5,672,097 (Hoopman); U.S. Pat. No. 5,681,217 (Hoopman et al.); U.S. Pat. No. 5,454,844 (Hibbard et al.); U.S. Pat. No. 5,851,247 (Stoetzel et al.); and U.S. Pat. No. 6,139,594 (Kincaid et al.), the disclosures of which are incorporated herein by reference.

Structured abrasive articles having precisely shaped abrasive composites that are useful for practicing the present invention are commercially available as films and/or discs, for example, as marketed under the trade designation "3M TRIZACT FINESSE-IT" by 3M Company, Saint Paul, Minn. Examples include "3M FINESSE-IT TRIZACT FILM, 466LA" (green silicon carbide abrasive grain, 4.0 micrometers mean particle size), "3M TRIZACT GC3000" (green silicon carbide abrasive grain, 4.0 micrometers mean particle size), "3M TRIZACT GC4000" (green silicon carbide abrasive grain, 3.0 micrometers mean particle size), "3M TRIZACT HOOKIT II FILM-568XA" (ceria abrasive grain), "3M TRIZACT HOOKIT II FILM-268XA" (aluminum oxide abrasive grain, available in A35, A20, A10 and A5 grit sizes).

In another embodiment, structured abrasive articles having larger abrasive composite sizes may also be useful for practicing the present invention, for example, those marketed under the trade designation "TRIZACT CF", available from 3M Company.

In yet another embodiment, the structured abrasive article may be prepared by coating a slurry comprising a polymerizable binder precursor, abrasive grains, and a silane coupling agent through a screen that is in contact with a backing. In this embodiment, the slurry is typically then further polymerized (e.g., by exposure to an energy source) while it is present in the openings of the screen thereby forming a plurality of shaped abrasive composites generally corresponding in shape to the screen openings. Further details concerning this type of screen coated structured abrasive may be found, for example, in U.S. Publ. Pat. Appl. No. 2001/0041511 (Lack et al.), the disclosure of which is incorporated herein by reference.

In yet another embodiment, a slurry comprising a polymerizable binder precursor, abrasive grains, and a silane coupling agent may be deposited on a backing in a patterned manner (e.g., by screen or gravure printing), partially polymerized to render at least the surface of the coated slurry plastic but non-flowing, a pattern embossed upon the partially polymerized slurry formulation, and subsequently further polymerized (e.g., by exposure to an energy source) to form a plurality of shaped abrasive composites affixed to the backing. Such embossed structured abrasive articles prepared by this and related methods are described, for example, in U.S. Pat. No. 5,833,724 (Wei et al.); U.S. Pat. No. 5,863,306 (Wei et al.); U.S. Pat. No. 5,908,476 (Nishio et al.); U.S. Pat. No. 6,048,375 (Yang et al.); U.S. Pat. No. 6,293,980 (Wei et al.); and U.S. Pat. Appl. Pub. No. 2001/0041511 (Lack et al.), the disclosures of which are incorporated herein by reference. Commercially available examples of such embossed structured abrasive articles are believed to include abrasive belts and discs available from Norton-St. Gobain Abrasives Company, Worcester, Mass., under the trade designation "NORAX" such as for example, "NORAX U264-X80", "NORAX U266-X30", "NORAX U264-X80", "NORAX U264-X45", "NORAX U254-X45, X30", "NORAX U264-X16", "NORAX U336-X5" and "NORAX U254-AF06".

The structured abrasive article can be any shape, for example, round (e.g., a disc), oval, scalloped edges, or rectangular (e.g., a sheet) depending on the particular shape of any support pad that may be used in conjunction with it, or it may form an endless belt. The structured abrasive article may have slots or slits therein and may be provided with perforations (e.g., a perforated disc).

The workpiece may comprise any material and may have any form. Examples of suitable materials include ceramic, paint, thermoplastic or thermoset polymers, polymeric coatings, polycrystalline silicon, wood, marble, and combinations thereof. Examples of substrate forms include molded and/or shaped articles (e.g., optical lenses, automotive body panels, boat hulls, counters, and sinks), wafers, sheets, and blocks. Methods according to the present invention are particularly useful for repair and/or polishing of polymeric materials such as motor vehicle paints and clearcoats (e.g., automotive clearcoats), examples of which include: polyacrylic-polyol-polyisocyanate compositions (e.g., as described in U.S. Pat. No. 5,286,782 (Lamb, et al.); hydroxyl functional acrylic-polyol-polyisocyanate compositions (e.g., as described in U.S. Pat. No. 5,354,797 (Anderson, et al.); polyisocyanate-carbonate-melamine compositions (e.g., as described in U.S. Pat. No. 6,544,593 (Nagata et al.); high solids polysiloxane compositions (e.g., as described in U.S. Pat. No. 6,428,898 (Barsotti et al.)). One suitable clearcoat comprises nano sized silica particles dispersed in a crosslinked polymer. An example of this clearcoat is available under the trade designation "CERAMICLEAR" from PPG Industries, Pittsburgh, Pa.

Other suitable polymeric materials that may be repaired and/or polished according to the present invention include marine gel coats, polycarbonate lenses, countertops and sinks made from synthetic materials, for example, such as those marketed under the trade designation "DUPONT CORIAN" by E.I. du Pont de Nemours & Company, Wilmington, Del.

Objects and advantages of this invention are further illustrated by the following non-limiting examples, but the particular materials and amounts thereof recited in these examples, as well as other conditions and, details, should not be construed to unduly limit this invention.

EXAMPLES

Unless otherwise noted, all reagents used in the examples were obtained, or are available, from general chemical suppliers such as Sigma-Aldrich Chemical Company, Saint Louis, Mo., or may be synthesized by conventional methods.

The following abbreviations are used in the Examples below:

"ABR1" refers to a structured abrasive disc having an abrasive layer composed of a close packed off-set array of tetrahedral abrasive composites each having a base width of 92 micrometers, a height of 63 micrometers, and composed of green silicon carbide abrasive grains (4.0 micrometers mean particle size) dispersed in a polymeric binder, obtained under the trade designation "3M TRIZACT FILM 466LA, A5 DISC" from 3M Company;

"ABR2" refers to a coated abrasive film, which was not a structured abrasive article obtained under the trade designation "7 MICRON 268L IMPERIAL MICRO FINISHING FILM" from 3M Company;

"ABR3" refers to a 1.25-inch (3.2 cm) disc having an abrasive layer composed of a quad array of shaped abrasive composites each having approximate base widths of between 1045×1315 and 1465×1325 micrometers, height of approximately 489 micrometers, composed of alumina abrasive grains dispersed in a polymeric binder, and die stamped from a structured abrasive belt obtained under the trade designation "NORAX X5 U336" from Norton-St. Gobain Abrasives Company, Worcester, Mass.;

"ABR4" refers to a 1.25-inch (3.2 cm) disc having an abrasive layer composed of a pyramidal array of multiple sized composites having approximate base widths of between 610×675 and 730×1008 micrometers, height of approximately 514 micrometers, composed of alumina abrasive grains dispersed in a polymeric binder, and die stamped from a structured abrasive belt obtained under the trade designation "NORAX AF06 U254" from Norton-St. Gobain Abrasives Company;

"ABR5" refers to a 1.25-inch (3.2 cm) disc having an abrasive layer composed of a close packed off-set array of tetrahedral abrasive composites each having a base width of 92 micrometers, a height of 63 micrometers, and composed of green silicon carbide abrasive grains (3.0 micrometers mean particle size) dispersed in a polymeric binder, obtained under the trade designation "3M TRIZACT GC 4000" from 3M Company;

"ABR6" refers to a structured abrasive disc having an abrasive layer composed of a close packed off-set array of tetrahedral abrasive composites each having a base width of 92 micrometers, a height of 63 micrometers, and composed of green silicon carbide abrasive grains (4.0 micrometers mean particle size) dispersed in a polymeric binder, obtained under the trade designation "3M TRIZACT GC 3000" from 3M Company;

"ABR7" refers to a structured abrasive disc made according to the Preparation of ABR7 procedure described hereinbelow;

"ABR8" refers to a structured abrasive disc made according to the Preparation of ABR8 procedure described hereinbelow;

"ACR1" refers to 2-phenoxy acrylate, commercially available under the trade designation "SR339" from Sartomer Company, Inc., Exton, Pa.;

"ACR2" refers to trimethylolpropane triacrylate, commercially available under the trade designation "SR351" from Sartomer Company, Inc.;

"AD1" refers to a hydrophobically modified polycarboxylic acid dispersant obtained under the trade designation "TAMOL 165A" from Rohm & Haas Company, Spring House, Pa.;

"AD2" refers to a polycarboxylic acid dispersant obtained under the trade designation "SOKALAN CP-10" from BASF Corporation, Mount Olive, N.J.;

"AD3" refers to a polycarboxylic acid dispersant obtained under the trade designation "SOKALAN PA-20" from BASF Corporation;

"AD4" refers to an aqueous solution of an ammonium salt of an acrylate copolymer dispersant obtained under the trade designation "BYK 156" from BYK-Chemie USA, Inc., Wallingford, Conn.;

"AD5" refers to modified polyurethane dispersant, obtained under the trade designation "EFKA 4550" from EKFA Additives Northern America, Inc., Stow, Ohio;

"NS1" refers to octylphenoxypolyethoxy-ethanol polyethylene glycol (a nonionic surfactant) obtained under the trade designation "TRITON X-100" from Dow Chemical Company, Midland, Mich.;

"AS1" refers to sodium dodecylbenzenesulfonate obtained under the trade designation "CALSOFT F90" from Pilot Chemical Company, Santa Fe Springs, Calif.;

"AS2" refers to sodium octanoate obtained from Aldrich Chemical Company, Milwaukee, Wis.;

"AS3" refers to sodium octyl sulfate obtained from Aldrich Chemical Company;

"AS4" refers to sodium dodecanoate obtained from Aldrich Chemical Company;

"AS5" refers to sodium dodecyl sulfate obtained from Aldrich Chemical Company;

"AS6" refers to a potassium salt of a phosphate ester obtained under the trade designation "TRITON H-66" from Dow Chemical Company;

"AS7" refers to sodium salt of amine $C_{12}$–$C_{14}$ tert-alkyl ethoxylated sulfate obtained under the trade designation "TRITON QS-15" from Dow Chemical Company;

"AS8" refers to sodium alkyl aryl ether sulfate obtained under the trade designation "TRITON W-30" from Dow Chemical Company;

"AS9" refers to 1,4-bis(2-ethylhexyl) sodium sulfosuccinate obtained under the trade designation "TRITON GR-5M" from Dow Chemical Company;

"AS10" refers to sodium alkyl aryl polyether sulfonate obtained under the trade designation "TRITON X-200" from Dow Chemical Company;

"CPA1" refers to gamma-methacryloxypropyltrimethoxy silane, commercially available under the trade designation "A-174" from Crompton Corporation, Middlebury, Conn.;

"MIN1" refers to green silicon carbide mineral, commercially available under the trade designation "GC 3000 GREEN SILICON CARBIDE" from Fujimi Corporation, Tualitin, Oreg.;

"DSP1" an anionic polyester dispersant, obtained under the trade designation "HYPERMER KD-10" from Uniqema, New Castle, Del.;

"TP1" refers to an automotive clearcoat test panel, commercially available under the trade designation "GEN IV AC" from Du Pont Automotive, Troy, Mich.;

"TP2" refers to an automotive clearcoat test panel, commercially available under the trade designation "E10CG066 2K4" from ACT Laboratory, Inc., Hillsdale, Mich.;

"TP3" refers to an automotive clearcoat test panel, commercially available under the trade designation "DCT5002H" from ACT Laboratory, Inc.;

"TP4" refers to an automotive clearcoat test panel, commercially available under the trade designation "CRT60000" from ACT Laboratory, Inc.;

"TP5" refers to an automotive clearcoat test panel, commercially available under the trade designation "E126CE012" from ACT Laboratory, Inc.;

"TP6" refers to an automotive clearcoat test panel, commercially available under the trade designation "GEN VI CC" from Du Pont Automotive; and "TP7" refers to an automotive clearcoat test panel, commercially available under the trade designation "PPG 2K CERAMICLEAR" from PPG Industries, Pittsburgh, Pa.; and "UVI1" refers to acylphosphine oxide, commercially available under the trade designation "LUCERIN TPO-L" from BASF Corporation, Florham Park, N.J.;

Preparation of ABR7

An abrasive slurry defined in parts by weight, was prepared as follows: 13.2 parts ACR1, 20.0 parts ACR2, 0.5 parts DSP1, 2.0 part CPA1, 1.1 parts UVI1 and 63.2 parts MIN1 were homogeneously dispersed for approximately 15 minutes at 20° C. using a laboratory air mixer. A 7×12 inch (17.8×30.5 cm) sheet of ethylene acrylic acid primed polyester, 3.75 mil (76.2 micrometers) thick, was taped to a flat aluminum plate. A 4.2 mil (106.7 micrometers) polypropylene monofilament mesh having 0.0041-inch square (104.1 micrometers square) openings was then taped onto the polyester film. The abrasive slurry was squeegeed into the propylene mesh and cured with two passes through a UV processor, obtained from American Ultraviolet Company, Lebanon, Ind., at a speed of 27 feet per minute (8.23 meters/minute) using two low pressure mercury arc lamps operating at 400 watts/inch (157.5 W/cm). The monofilament mesh was removed and a double-sided pressure-sensitive adhesive tape was laminated to the polyester support. 1.25-inch (3.2 cm) discs were then die stamped from the structured abrasive sheet.

Preparation of ABR8

The process described in Preparation of ABR7 was used, except that the polyester sheet was taped to the outside of a 1-gallon (3.785 liter) metal can having a diameter of 6.5 inches (16.5 cm). The monofilament mesh was then taped to the polyester sheet, the combined structure removed then from the metal can and taped to the flat aluminum plate.

The following test methods were used in the Examples below.

Cut-Life Test

The cut-life test is performed as follows:

A disc having a diameter of 1.25 inches (3.18 cm) of the indicated abrasive article is adhered to a 5-inch (12.7 cm) by 1.25 inches (3.18 cm) thick vinyl faced foam back up pad (available under the trade designation "3M FINESSE-IT STIKIT BACKUP PAD" from 3M Company). The back up pad is mounted on a fine finishing orbital sander available under the trade designation "DYNABRADE MODEL 59025" from Dynabrade, Inc., Clarence, N.Y.

The abrasive layer of the disc is then misted with the indicated liquid in an amount sufficient to cover the entire surface of the abrasive layer using 1 or 2 squirts of liquid from a 24 ounce spray bottle. The abrasive layer is manually brought into contact with the workpiece, which is then abraded for 3 to 5 seconds at 7,500 revolutions per minute (rpm) at 90 psi (621 kilopascals) and an angle of zero degrees (i.e., manually held flat to the surface of the workpiece). The misting and abrading steps are repeated on adjacent areas of the test panel until the abrasive disc becomes clogged with debris, as visually indicated by incomplete clear coat removal. The number of times the abrasive disc can be used without clogging (i.e., number of cycles) is reported as the cut-life of the abrasive disc.

Examples 1–50 & Comparative Examples A–W

Liquids were prepared by combining surfactant and water in the amounts indicated in Table 1. Cut-life was determined according to the Cut-Life Test using the workpiece indicated in Table 1. Results of the Cut-Life Test are reported in Table 1 (below).

TABLE 1

| | | | Liquid | | |
|---|---|---|---|---|---|
| | Abrasive Article | Work-piece | Sur-factant | Concentration of Surfactant in Water, percent by weight | Cut-Life, Number of Cycles |
| Comparative Example A | ABR1 | TP1 | none | 0 | 6 |
| Comparative Example B | ABR1 | TP2 | none | 0 | 4 |
| Comparative Example C | ABR1 | TP3 | none | 0 | 5 |
| Comparative Example D | ABR1 | TP4 | none | 0 | 3 |
| Comparative Example E | ABR1 | TP5 | none | 0 | 2 |
| Comparative Example F | ABR1 | TP6 | none | 0 | 2 |
| Comparative Example G | ABR1 | TP1 | NS1 | 1.0 | 6 |
| Comparative Example H | ABR1 | TP1 | AS2 | 1.0 | 7 |
| Comparative Example I | ABR1 | TP1 | AS3 | 1.0 | 5 |
| Comparative Example J | ABR1 | TP1 | AS6 | 1.0 | 6 |
| Comparative Example K | ABR2 | TP1 | none | 0 | 8 |
| Comparative Example L | ABR2 | TP1 | AS1 | 1.0 | 9 |
| Example 1 | ABR1 | TP1 | AS1 | 1.0 | 19 |
| Example 2 | ABR1 | TP1 | AS1 | 3.0 | 24 |
| Example 3 | ABR1 | TP1 | AD1 | 3.0 | 12 |
| | | | AS1 | 0.05 | |
| Example 4 | ABR1 | TP1 | AD2 | 3.0 | 13 |
| | | | AS1 | 0.05 | |
| Example 5 | ABR1 | TP1 | AD3 | 3.0 | 9 |
| | | | AS1 | 0.05 | |
| Example 6 | ABR1 | TP1 | AS1 | 0.05 | 5 |
| Example 7 | ABR1 | TP1 | AS1 | 0.1 | 5 |
| Example 8 | ABR1 | TP1 | AS1 | 0.5 | 40 |
| Example 9 | ABR1 | TP1 | AS1 | 1.0 | 19 |
| Example 10 | ABR1 | TP1 | AS1 | 3.0 | 24 |
| Example 11 | ABR1 | TP1 | AS4 | 0.5 | 28 |
| Example 12 | ABR1 | TP1 | AS5 | 0.5 | 25 |
| Example 13 | ABR1 | TP1 | AS5 | 1.0 | 22 |
| Example 14 | ABR1 | TP1 | AS7 | 1.0 | 18 |
| Example 15 | ABR1 | TP1 | AS8 | 1.0 | 25 |
| Example 16 | ABR1 | TP1 | AS9 | 1.0 | 36 |
| Example 17 | ABR1 | TP1 | AS10 | 1.0 | 37 |
| Example 18 | ABR1 | TP2 | AS1 | 1.0 | 16 |
| Example 19 | ABR1 | TP2 | AS5 | 1.0 | 14 |
| Example 20 | ABR1 | TP2 | AS8 | 1.0 | 15 |
| Example 21 | ABR1 | TP2 | AS9 | 1.0 | 19 |
| Example 22 | ABR1 | TP2 | AS10 | 1.0 | 17 |
| Example 23 | ABR1 | TP3 | AS1 | 1.0 | 21 |
| Example 24 | ABR1 | TP3 | AS5 | 1.0 | 19 |
| Example 25 | ABR1 | TP3 | AS8 | 1.0 | 10 |
| Example 26 | ABR1 | TP3 | AS9 | 1.0 | 21 |
| Example 27 | ABR1 | TP3 | AS10 | 1.0 | 11 |

TABLE 1-continued

| | | | Liquid | | |
|---|---|---|---|---|---|
| | Abrasive Article | Work-piece | Sur-factant | Concentration of Surfactant in Water, percent by weight | Cut-Life, Number of Cycles |
| Example 28 | ABR1 | TP4 | AS1 | 1.0 | 15 |
| Example 29 | ABR1 | TP4 | AS5 | 1.0 | 16 |
| Example 30 | ABR1 | TP4 | AS8 | 1.0 | 16 |
| Example 31 | ABR1 | TP4 | AS9 | 1.0 | 20 |
| Example 32 | ABR1 | TP4 | AS10 | 1.0 | 20 |
| Example 33 | ABR1 | TP5 | AS1 | 1.0 | 16 |
| Example 34 | ABR1 | TP5 | AS5 | 1.0 | 10 |
| Example 35 | ABR1 | TP5 | AS8 | 1.0 | 10 |
| Example 36 | ABR1 | TP5 | AS9 | 1.0 | 19 |
| Example 37 | ABR1 | TP5 | AS10 | 1.0 | 9 |
| Example 38 | ABR1 | TP1 | AS1 | 1.0 | 14 |
| Example 39 | ABR1 | TP6 | AS9 | 1.0 | 13 |
| Comparative Example M | ABR1 | TP6 | None | 0 | 4 |
| Comparative Example N | ABR3 | TP6 | None | 0 | 2 |
| Comparative Example O | ABR4 | TP6 | None | 0 | 2 |
| Comparative Example P | ABR5 | TP7 | None | 0 | 6 |
| Comparative Example Q | ABR6 | TP7 | None | 0 | 2 |
| Example 40 | ABR1 | TP6 | AS9 | 1.0 | 15 |
| Example 41 | ABR3 | TP6 | AS9 | 1.0 | 33 |
| Example 42 | ABR4 | TP6 | AS9 | 1.0 | 12 |
| Example 43 | ABR5 | TP7 | AS9 | 1.0 | 10 |
| Example 44 | ABR6 | TP7 | AS9 | 1.0 | 10 |
| Comparative R | ABR7 | TP1 | None | 0 | 2 |
| Comparative S | ABR8 | TP1 | None | 0 | 2 |
| Comparative T | ABR1 | TP1 | None | 0 | 5 |
| Comparative U | ABR1 | TP1 | None | 0 | 4 |
| Comparative V | ABR3 | TP1 | None | 0 | 2 |
| Comparative W | ABR4 | TP1 | None | 0 | 2 |
| Example 45 | ABR7 | TP1 | AS9 | 1.0 | 26 |
| Example 46 | ABR8 | TP1 | AS9 | 1.0 | 27 |
| Example 47 | ABR1 | TP1 | AS9 | 1.0 | 14 |
| Example 48 | ABR1 | TP1 | AS9 | 1.0 | 15 |
| Example 49 | ABR3 | TP1 | AS9 | 1.0 | 34 |
| Example 50 | ABR4 | TP1 | AS9 | 1.0 | 12 |

Various unforeseeable modifications and alterations of this invention may be made by those skilled in the art without departing from the scope and spirit of this invention, and it should be understood that this invention is not to be unduly limited to the illustrative embodiments set forth herein.

What is claimed is:

1. A method of abrading a surface of a workpiece comprising:

providing a structured abrasive article comprising a backing having opposed major surfaces and an abrasive layer comprising a plurality of shaped abrasive composites bonded to one of the major surfaces, wherein the abrasive composites comprise abrasive grains dispersed in a polymeric binder, and wherein the abrasive composites are preparable by at least partially polymerizing a slurry comprising a polymerizable binder precursor, abrasive grains, and a silane coupling agent;

contacting the abrasive layer with the surface of the workpiece, wherein the surface of the workpiece is an automotive clearcoat;

contacting a liquid comprising water and sulfate anionic surfactant with at least one of the workpiece or the abrasive article; and moving at least one of the abrasive layer and the surface of the workpiece relative to the other to abrade at least a portion of the surface of the workpiece.

2. A method according to claim 1, wherein the shaped abrasive composites are precisely shaped.

3. A method according to claim 1, wherein at least a portion of the shaped abrasive composites are not precisely shaped.

4. A method according to claim 1, wherein the sulfate anionic surfactant is selected from the group consisting of alkyl polyether sulfates, alkyl aryl ether sulfates, alkyl sulfates, and combinations thereof.

5. A method according to claim 1, wherein the sulfate anionic surfactant is selected from the group consisting of octyl sulfate, dodecyl sulfate, and combinations thereof.

6. A method according to claim 1, wherein the liquid comprises sulfate anionic surfactant in an amount of from at least 0.1 percent up to and including 5 percent by weight, based on the total weight of the composition.

7. A method according to claim 1, wherein the liquid comprises sulfate anionic surfactant in an amount of from at least 0.5 percent up to and including 3 percent by weight, based on the total weight of the composition.

8. A method according to claim 7, wherein the sulfate anionic surfactant is selected from the group consisting of octyl sulfate, dodecyl sulfate, and combinations thereof.

9. A method according to claim 1, wherein the liquid consists essentially of water and sulfate anionic surfactant.

10. A method according to claim 1, wherein the liquid further comprises organic solvent.

11. A method according to claim 1, wherein the liquid further comprises at least one of a thickener, filler, colorant, or grinding aid.

12. A method according to claim 1, wherein the liquid is directly applied to the workpiece.

13. A method according to claim 12, wherein the liquid contacts the workpiece prior to contacting rho abrasive layer with the surface of the workpiece.

14. A method according to claim 1, wherein the liquid is directly applied to the abrasive layer.

15. A method according to claim 14, wherein the liquid contacts the abrasive layer prior to contacting the abrasive layer with the surface of the workpiece.

16. A method according to claim 14, wherein the liquid contacts at least one of the abrasive layer and the workpiece after contacting the abrasive layer and the workpiece.

17. A method according to claim 1, wherein the liquid is discontinuously applied to at least one of the abrasive layer or the workpiece.

18. A method according to claim 1, wherein the workpiece comprises glass, metal, paint, a polymeric clearcoat, polycrystalline silicon, or a combination thereof.

19. A method according to claim 1, wherein the workpiece comprises at least one of a motor vehicle clearcoat or a marine gel coat.

20. A method according to claim 1, wherein the abrasive layer is discontinuous.

21. A method according to claim 1, wherein the structured abrasive article comprises a disc.

22. A method according to claim 1, wherein the abrasive grains have an average particle size in a range of from at least 3 micrometers up to and including 35 micrometers.

* * * * *

UNITED STATES PATENT AND TRADEMARK OFFICE

CERTIFICATE OF CORRECTION

PATENT NO. : 7,278,904 B2
APPLICATION NO. : 10/982503
DATED : October 9, 2007
INVENTOR(S) : Edward J. Woo It is certified that error appears in the above-identified patent and that said Letters Patent is hereby corrected as shown below:

Title Page;

Page 2, Column 2
Line 2, Other Publications, delete "Huntigton," and insert -- Huntington, -- in place thereof.

Column 14
Line 4, Claim 13, delete "rho" and insert -- the -- in place thereof.

Signed and Sealed this

Twenty-fifth Day of December, 2007

JON W. DUDAS
*Director of the United States Patent and Trademark Office*